US007040236B2

(12) United States Patent
Oh

(10) Patent No.: US 7,040,236 B2
(45) Date of Patent: May 9, 2006

(54) ENVIRONMENTALLY-FRIENDLY TRAINING HAND GRENADE AND MANUFACTURING METHOD OF THE SAME

(75) Inventor: Se-Hong Oh, Seoul (KR)

(73) Assignee: C.N.O. Tech Korea Co., Ltd., (KR)

( * ) Notice: Subject to any disclaimer, the term of this patent is extended or adjusted under 35 U.S.C. 154(b) by 7 days.

(21) Appl. No.: 10/818,297

(22) Filed: Apr. 5, 2004

(65) Prior Publication Data

US 2005/0028703 A1 Feb. 10, 2005

(30) Foreign Application Priority Data

Apr. 9, 2003 (KR) ..... 10-2003-0022287
Dec. 30, 2003 (KR) ..... 10-2003-0099626

(51) Int. Cl.
*F42B 33/00* (2006.01)

(52) U.S. Cl. ..... 102/498; 102/482

(58) Field of Classification Search ..... 102/482–488, 102/498

See application file for complete search history.

(56) References Cited

U.S. PATENT DOCUMENTS 6,065,404 A * 5/2000 Ripingill et al. ..... 102/498
6,470,805 B1 * 10/2002 Woodall et al. ..... 102/370
2005/0022657 A1 * 2/2005 O'Dwyer ..... 89/1.41

FOREIGN PATENT DOCUMENTS

EP 957330 A2 * 11/1999
FR 2816399 A1 * 5/2002

* cited by examiner

*Primary Examiner*—Troy Chambers
(74) *Attorney, Agent, or Firm*—Galgano & Burke, LLP

(57) ABSTRACT

Disclosed is an environmentally-friendly training hand grenade and a method of manufacturing the same. The training hand grenade is advantageous in that it is not necessary to recover fragments, generated by the explosion of the training hand grenade after use, because a bomb body of the training hand grenade is made of naturally degradable mineral matters, such as barite, tungsten, silica, and yellow earth, thereby many soldiers may be trained for a relatively short time using the training hand grenade. Furthermore, the training hand grenade is made of environmentally-friendly materials, and thus, its use is conducted without causing pollution. In addition, the training hand grenade is made of the mineral matters, thereby ensuring high explosiveness and explosive sound effect when the training hand grenade is exploded, and preventing soldiers from being injured by the fragments in use. Moreover, the training hand grenade has almost the same weight as a hand grenade for live battle, leading to the simplification of the manufacture of the training hand-grenade to improve productivity. Accordingly, the manufacturing costs of the training hand grenade are largely reduced, which contributes to reducing prices of the training hand grenade.

3 Claims, 4 Drawing Sheets

--PRIOR ART--

ENVIRONMENTALLY-FRIENDLY TRAINING HAND GRENADE AND MANUFACTURING METHOD OF THE SAME

BACKGROUND OF THE INVENTION

1. Field of the Invention

The present invention pertains, in general, to a training hand grenade and, more particularly, to an environmentally-friendly training hand grenade, of which a bomb body is made of a naturally degradable material to prevent pollution by fragments of the training hand grenade after explosion even though the fragments are not recovered, and a method of manufacturing the same.

2. Description of the Prior Art

Belonging to a small bomb used in battle against enemies to eliminate the enemies or to destroy arms of the enemies, a hand grenade is light enough in weight to allow a user to take it by his hand and throw it, and includes a bomb body containing a bursting charge, and a fuse body to ignite the bursting charge in the bomb body. In this regard, the fuse body is provided with a safety ring, a safety clip, and a safety grip.

The hand grenade is classified into a fragmentation grenade to eliminate the enemies, an attack grenade to destroy the arms of the enemies, a gas grenade to reduce a military potential of the enemies, and a signal smoke grenade according to an object of its use. Having great explosiveness, the hand grenade potentially harms our forces as well as the user when the user carelessly handles it. Accordingly, it is necessary to enable the user to be fully aware of usage of the hand grenade and safety regulation regarding the hand grenade.

If soldiers are not in live battle, they train with the use of a training hand grenade having relatively small explosiveness. The body and fuse of the training hand grenade mostly consist of metal materials, and thus, fragments generated by the explosion of the training hand grenade have been recovered and reused.

With reference to FIG. 1, there is illustrated a sectional view of a conventional training hand grenade. The conventional training hand grenade includes a case 1, constituting a lower body, made of a synthetic rubber material, a fuse body 2 screwed into an upper part of the case 1, a retarding agent 3 and a detonator 4 sequentially located under the fuse body 2, and a bursting charge 5, composed of iron contents and various inorganics, charged in the case 1 to allow a weight of the training hand grenade to be roughly equal to that of the hand grenade for live battle. Referential numerals 6, 7, and 8 denote a pestle, a safety pin, and a primer, respectively.

However, the conventional training hand grenade is disadvantageous in that if the fragments generated by the explosion of the hand grenade are not recovered, the case and fuse body of the hand grenade are readily used to produce a pseudo-explosive used for other purposes, and that pollution is caused by the fragments because the hand grenade is not easily decomposed.

Other disadvantages of the conventional training hand grenade are that a relatively long time and a lot of manpower are consumed in order to recover the case and fuse body of the training hand grenade after the training of the soldiers because of irregular natural features and weeds of a training camp, training efficiency of the soldiers is reduced because the soldiers each undertake responsibility to recover used hand grenades, and there is a risk to lose the case and fuse body of the training hand grenade.

Furthermore, the productivity is reduced because the bursting charge 5 is charged in the case 1 after the case 1 is manufactured.

SUMMARY OF THE INVENTION

Therefore, the present invention has been made keeping in mind the above disadvantages occurring in the prior arts, and an object of the present invention is to provide an environmentally-friendly training hand grenade, of which a bomb body is made of a naturally degradable material. Accordingly, it is not necessary to recover fragments of the training hand grenade after use, leading to the reduction of a training time of soldiers and the prevention of pollution by the fragments.

It is another object of the present invention to provide a method of manufacturing an environmentally-friendly training hand grenade, in which the training hand grenade has an integrated solid structure of a case and a bursting charge, thereby improving the workability.

The above and/or other objects are achieved by providing an environmentally-friendly training hand grenade, including a fuse body made of a biodegradable resin. Additionally, a bomb body is screwed over the fuse body at an upper part thereof, and has an integrated solid structure which has no charging space therein. At this time, the bomb body is made of a mixture of naturally degradable mineral matters including barite, tungsten, silica, and yellow earth.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
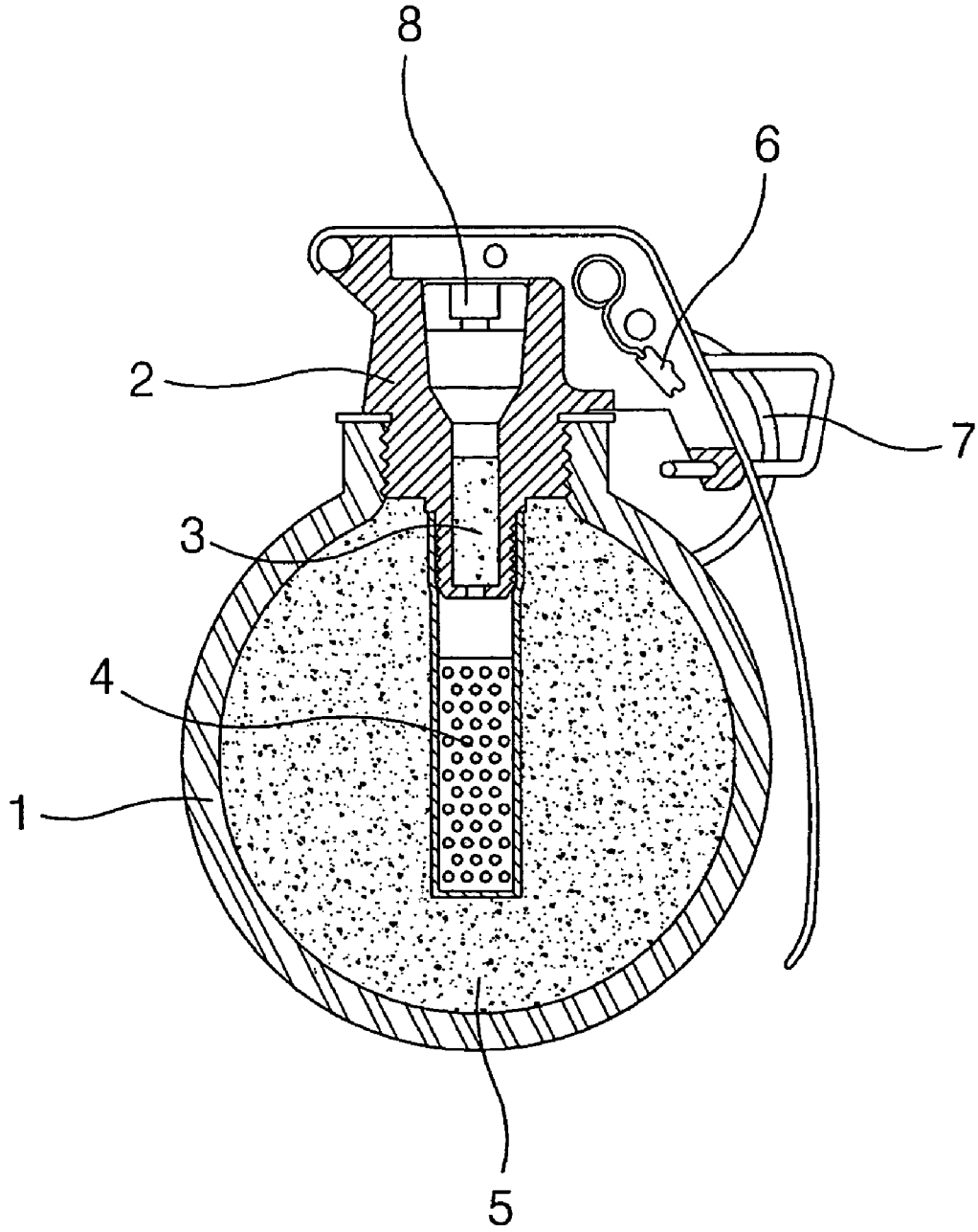
FIG. 1 is a sectional view of a conventional training hand grenade.

Reference now should be made to the drawings, in which the same reference numerals are used throughout the different drawings to designate the same or similar components.

Figure 2:
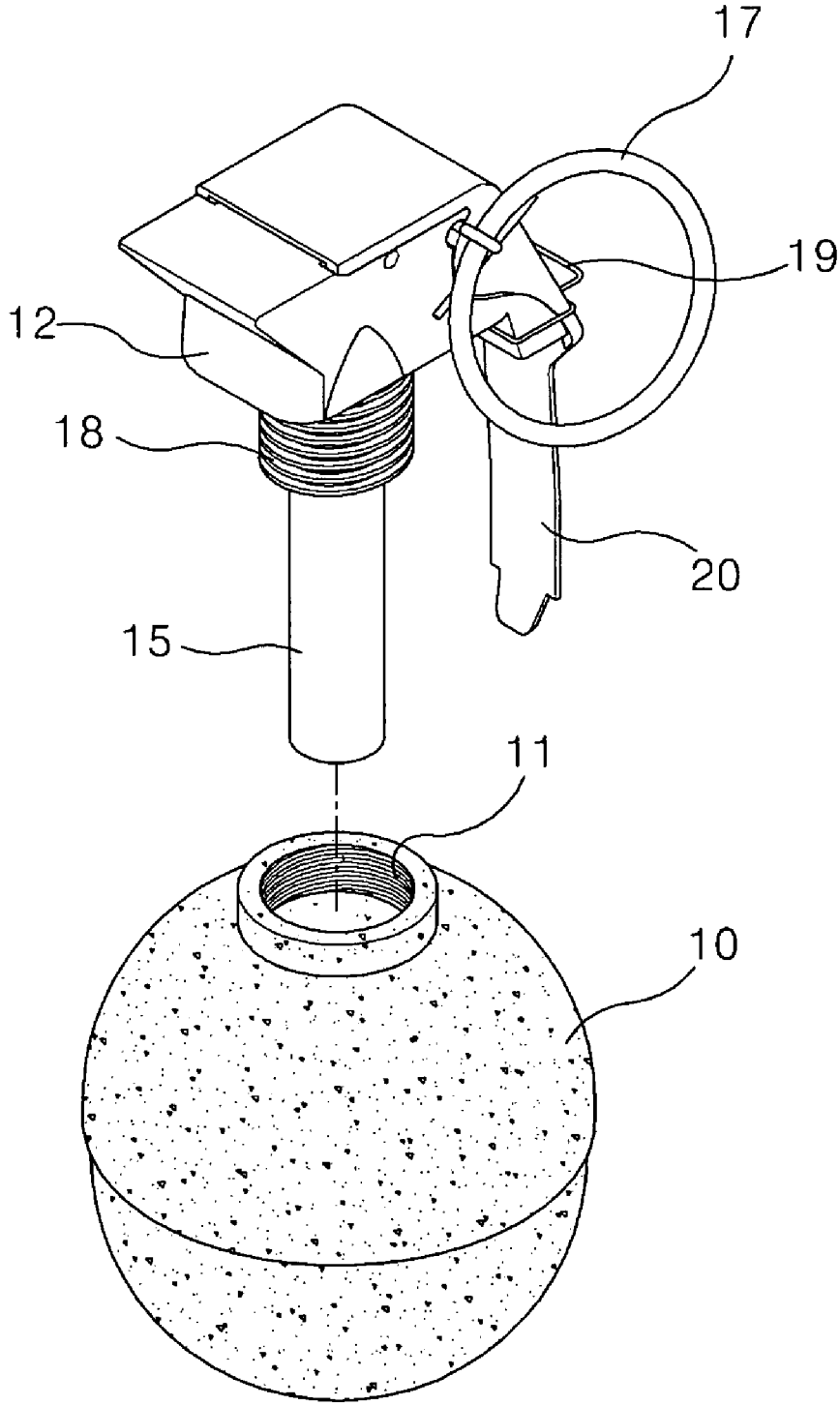
FIG. 2 is an exploded perspective view of a training hand grenade according to the present invention.
Figure 3:
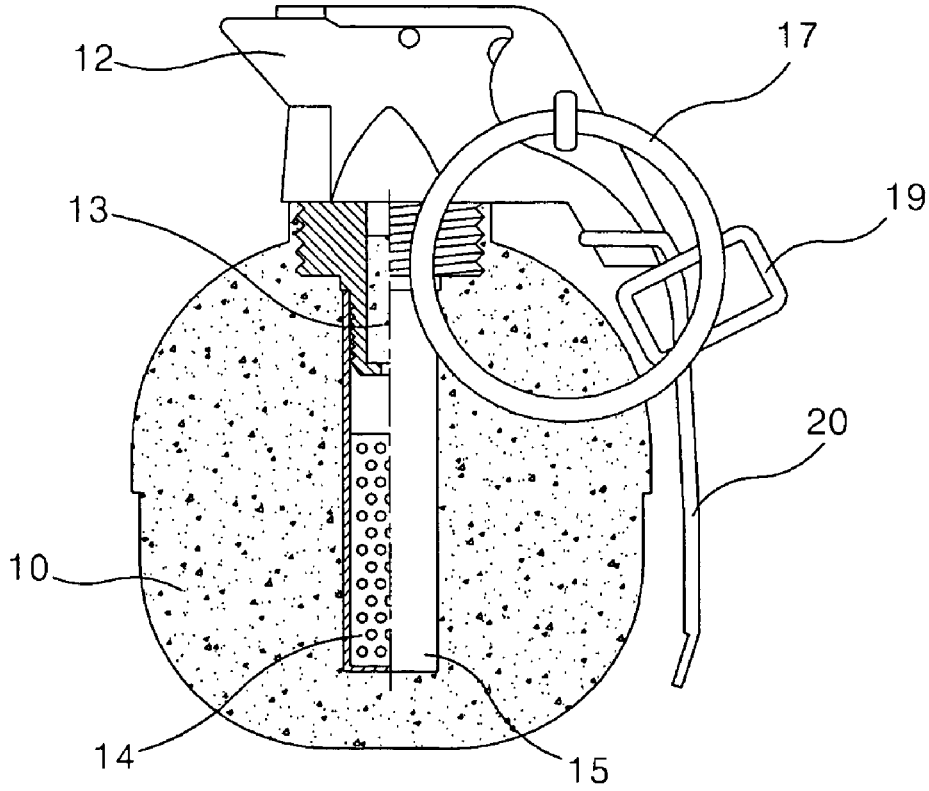
FIG. 3 is a partially sectional view of the training hand grenade according to the present invention.

With reference to FIGS. 2 and 3, there are illustrated an exploded perspective view a partially sectional view of an environmentally-friendly training hand grenade according to the present invention. The training hand grenade includes a cartridge 15, containing a detonator 14 at a lower portion thereof, a fuse body 12, made of a biodegradable plastic resin, containing a retarding agent 13, and a bomb body 10 screwed over the fuse body 12. At this time, the bomb body 10 has an integrated solid structure in which there is no space to be charged with a separate charging material.

Particularly, the bomb body 10 of the training hand grenade according to the present invention is made of a mixture of mineral matters, such as barite, tungsten, silica, and yellow earth, and it is preferable that the mixture contain 80 to 90 wt % of barite, 5 to 10 wt % of tungsten, 0.1 to 0.5 wt % of silica, and 2 to 3 wt % of yellow earth. Of the above mineral matters, barite and tungsten have specific gravity of four or more, which is a lot higher than that of crushed rock (average: 1.45). Accordingly, the training hand grenade of the present invention has a similar weight to a hand grenade for live battle without increasing a volume of the bomb body 10 of the training hand grenade.

Meanwhile, the fuse body 12 is made of a very dense material, and includes an external threaded part 18 formed around a cylindrical middle part thereof to be screwed into the bomb body 10, a safety ring 1.7 and a safety clip 19 at an upper part thereof, and a safety grip 20 downwardly extended from the upper part thereof. In this respect, polycaprolactone (PCL) or polybutylene succinate (PBS) is mixed with biodegradable starch (corn starch or potato starch), and inorganics, such as talc, are then added into the resulting mixture to produce the very dense material.

Figure 4:
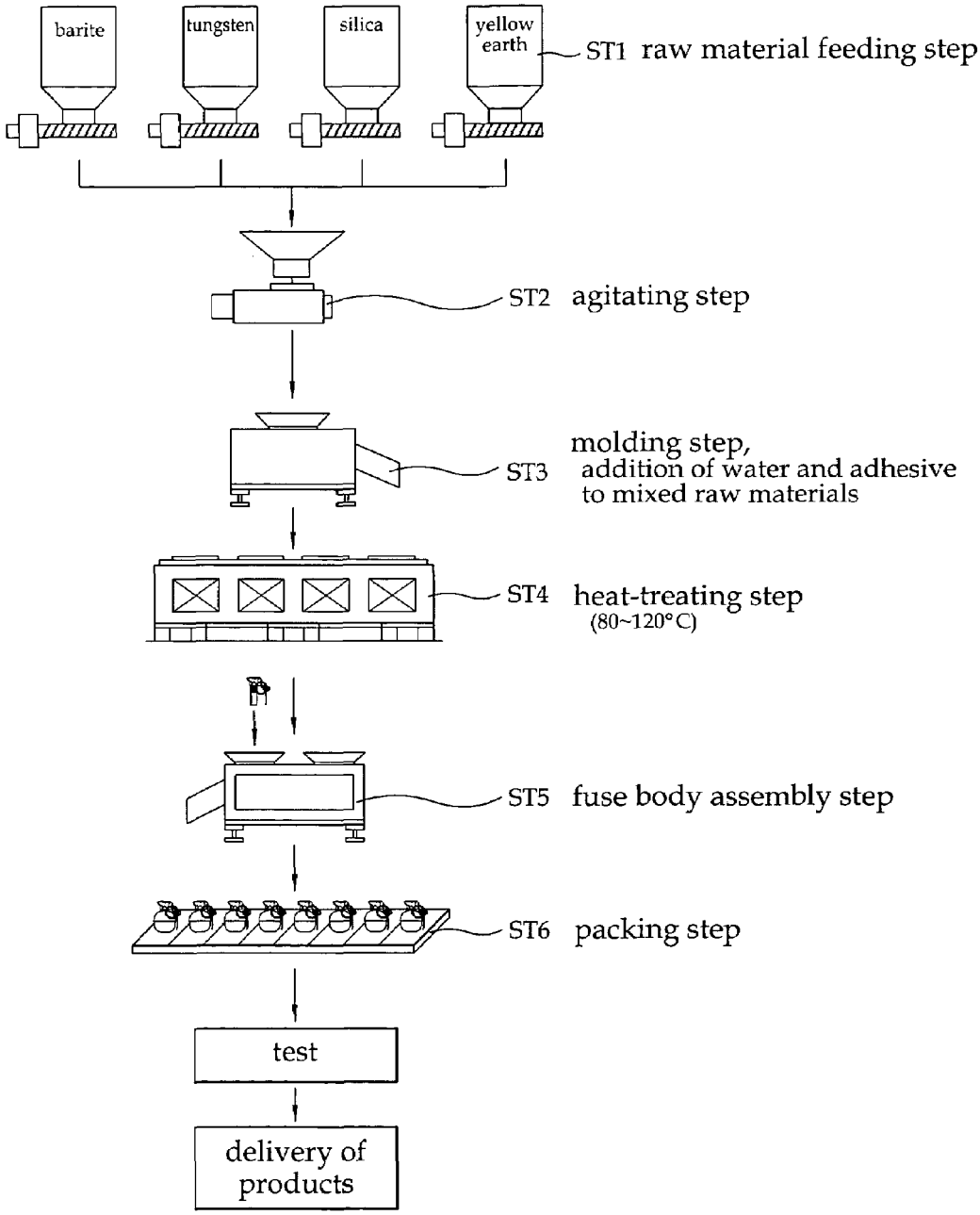
FIG. 4 schematically illustrates the manufacture of the training hand grenade according to the present invention.

Referring to FIG. 4, there is illustrated the manufacture of the environmentally-friendly training hand grenade according to the present invention.

Barite powder, tungsten powder, silica powder, and yellow earth powder are fed in a predetermined composition ratio through a feeding hopper into an agitator at operation 1 (raw material feeding step), and then sufficiently agitated in the agitator to be uniformly mixed with each other at operation 2 (agitating step).

After an adhesive and water are further added to the resulting mixture at operation 3. (molding step), the resulting mixture is molded in a molder to form the bomb body 10 in which a bore is formed to receive the cartridge 15 at operation 3 (molding step). At this time, an internally-threaded part 11 is formed at a neck of the bomb body 10 to be screwed over the externally-threaded part 18 of the fuse body 12. With respect to this, it is preferable that the adhesive be added to raw materials in an amount of 5 to 8 wt % based on a total weight of the raw materials. Useful as the adhesive is carboxymethyl cellulose (CMC) in the present invention.

The bomb body 10 is heat-treated in a furnace so as to improve strength thereof at operation 4 (heat-treating step). In this respect, the furnace is maintained at about 80 to 120° C. to increase explosiveness of the training hand grenade and prevent the training hand grenade from being damaged during the manufacture, circulation, and deposit of the training hand grenade.

Subsequently, the internally-threaded part 11 of the bomb body 10 having strength improved through the heat-treating step is screwed over the externally-threaded part 18 of the fuse body 12 made of a biodegradable plastic material in a rolling device at operation 5 (fuse body assembly step). In this regard, the fuse body 12 and the bomb body 10 are manufactured through different procedures.

The bomb body 10 screwed over the fuse body 12 is subjected to a post-process, for example a coloring process to be colored with a predetermined color, and then packed to be safely deposited and transported at operation 6 (packing step), thereby completing the environmentally-friendly training hand grenade. Some samples of hand grenade products are tested, and then delivered to users.

Accordingly, the environmentally-friendly training hand grenade of the present invention is advantageous in that the bomb body 10, constituting the training hand grenade, mostly consists of the mineral matters easily obtained. Particularly, the bomb body 10 includes a large amount of barite and tungsten with relatively high specific gravity. Hence, the training hand grenade of the present invention has almost the same weight and design as a hand grenade for live battle made of metals, thereby enabling the soldiers, using the training hand grenade of the present invention, to be trained under the same condition as live battle.

Another advantage of the training hand grenade according to the present invention is that it is not necessary to recover the fragments generated by the explosion of the training hand grenade after use because the training hand grenade includes the bomb body 12 made of the naturally degradable mineral matters and the fuse body 20 made of biodegradable starch.

The present invention has been described in an illustrative manner, and it is to be understood that the terminology used is intended to be in the nature of description rather than of limitation. Many modifications and variations of the environmentally-friendly training hand grenade and a method of manufacturing the same, according to the present invention, are possible in light of the above teachings.

For example, in the present invention, the bomb body of the training hand grenade is made of a mixture of the mineral matters, such as barite, tungsten, silica, and yellow earth, and the fuse body is made of the biodegradable starch. However, the fuse body may be made of other naturally degradable and environmentally-friendly materials.

Therefore, it is to be understood that within the scope of the appended claims, the invention may be practiced otherwise than as specifically described.

As apparent from the above description, an environmentally-friendly training hand grenade according to the present invention is advantageous in that it is not necessary to recover fragments, generated by the explosion of the training hand grenade after explosion, because a bomb body of the training hand grenade is made of naturally degradable mineral matters, thereby many soldiers may be trained for a relatively short time using the training hand grenade.

Furthermore, the training hand grenade is made of environmentally-friendly materials, and thus, its use is conducted without causing pollution. In addition, the training hand grenade is made of the mineral matters, thereby ensuring high explosiveness and explosive sound effect when the training hand grenade is exploded, and preventing soldiers from being injured by the fragments in use.

Moreover, the training hand grenade has roughly the same weight as a hand grenade for live battle even though it has an integrated solid structure without being charged by a separate charging material, leading to the simplification of the manufacture of the training hand grenade to improve productivity. Accordingly, the manufacturing costs of the training hand grenade are largely reduced, which contributes to reducing prices of the training hand grenade.

What is claimed is:

1. An environmentally-friendly training hand grenade, comprising:

a fuse body made of a biodegradable resin; and a bomb body screwed over the fuse body at an upper part thereof, having an integrated solid structure which has no charging space therein, and made of a mixture of naturally degradable mineral matters including barite, tungsten, silica, and yellow earth.

2. The environmentally-friendly training hand grenade as set forth in claim 1, wherein the bomb body comprises 80 to 90 wt % of barite, 5 to 10 wt % of tungsten, 0.1 to 0.5 wt % of silica, and 2 to 3 wt % of yellow earth.

3. A method of manufacturing an environmentally-friendly training hand grenade, provided with a bomb body and a fuse body, comprising:

a raw material feeding step of feeding raw materials, including barite, tungsten, silica, and yellow earth, into an agitator to manufacture the bomb body;

an agitating step of agitating the raw materials to uniformly mix the raw materials with each other;

a molding step of adding an adhesive and water to the mixed raw materials, and molding the resulting mixture to form the bomb body and to simultaneously form an internally-threaded part at a center part of an upper part of the bomb body;

a heat-treating step of heat-treating the bomb body to improve strength of the bomb body;

a fuse body assembly step of screwing the internally-threaded part of the bomb body, having the strength improved through the heat-treating step, over an externally-threaded part of the fuse body made of a biodegradable resin to manufacture the training hand grenade; and a packing step of packing the training hand grenade.

* * * * *